United States Patent [19]

Gebhard

[11] 3,989,173

[45] Nov. 2, 1976

[54] HINGED LEG STAND FOR CHILD CARRIER

[75] Inventor: Albert W. Gebhard, Boulder, Colo.

[73] Assignee: Gerico, Inc., Boulder, Colo.

[22] Filed: Apr. 2, 1973

[21] Appl. No.: 347,195

[52] U.S. Cl. ..... 224/6; 224/8 A; 224/25 A; 248/412; 297/377; 403/409

[51] Int. Cl.[2] ..... A47D 13/02

[58] Field of Search ..... 224/6, 9, 8 A, 25 A; 297/377; 248/412; 403/104, 103, 102, 409

[56] References Cited

UNITED STATES PATENTS

| | | | |
|---|---|---|---|
| 2,649,104 | 8/1953 | Militano | 403/103 X |
| 3,272,556 | 9/1966 | Rocker | 297/377 X |
| 3,421,670 | 1/1969 | Hansson | 224/6 |
| 3,437,060 | 4/1969 | Giambalvo | 248/412 X |
| 3,528,701 | 9/1970 | Laughlin | 297/377 X |
| 3,715,568 | 1/1973 | 3,713, | 224/6 |

*Primary Examiner*—Robert J. Spar
*Assistant Examiner*—Jerold M. Forsberg
*Attorney, Agent, or Firm*—John E. Reilly

[57] ABSTRACT

A child carrier of the type adapted to be carried on a person's back and having a framework with spaced side frame members includes a novel form of leg stand with a hinged connection to the side frame members for movement between an extended supporting position and a contracted non-supporting position so as to cooperate with the framework when extended to stabilize the child carrier in a vertical orientation on a supporting surface and which when contracted fits closely adjacent to the framework so as not to be an encumbrance when the child carrier is used to support a child on the person's back.

13 Claims, 10 Drawing Figures

HINGED LEG STAND FOR CHILD CARRIER

Figure 1:
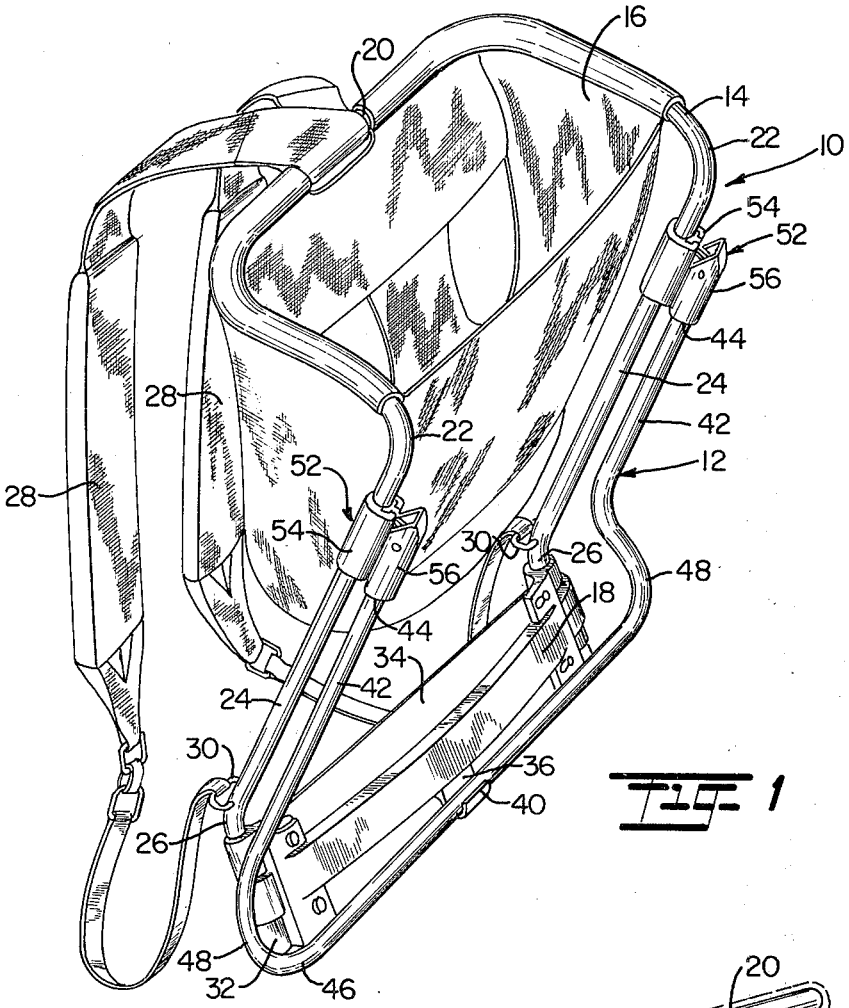

The present invention generally relates to leg stands for child carriers of the type adapted to be carried on a person's back and more particularly relates to an extendable leg stand for a child carrier of the type adapted to be carried on a person's back so that the carrier can be stabilized in a vertical orientation on a supporting surface in a safe and dependable manner.

Carriers for carrying small children on the back have come into widespread use in place of strollers, wheeled carts, carriages and the like. An example of such a carrier is disclosed in U.S. Pat. No. 3,421,670 issued to M. S. Hansson which is of common ownership with the present application. While the carriers of the aforementioned type have enjoyed considerable success, it has become desirable to provide a supporting stand or other stabilizing means for the carrier so that the carrier is self-supporting on a surface to facilitate placement of the child in the carrier prior to lifting the carrier onto the person's back. Furthermore, such a supporting means could serve to convert the child carrier into a stable play seat for the child which could be readily transported and set up at any desirable location.

Devices have been contrived for supporting backpack-type child carriers so that the child can be placed in the carrier before it is lifted onto the back but these devices have not been entirely satisfactory. Normally, the devices do not provide the necessary stabilizing effect necessary to safely support a squirming child or they are not desirably incorporated onto the carrier and thereby are either discomforting to the user or are unnecessarily heavy and/or bulky.

Accordingly, it is a primary object of the present invention to provide a new and improved backpack-type child carrier having a support stand which will brace and positively support the carrier on a support surface and which can be folded into compact relationship with the carrier so as not to be bulky or discomforting when the carrier is used to carry the child on the back.

It is another object of the present invention to provide a backpack-type child carrier having a support stand pivotally connected to the frame of the carrier so as to be movable from a contracted non-supporting position closely adjacent to the frame of the carrier to an extended supporting position wherein it provides a broad supporting or bracing leg for the carrier to reliably stabilize the carrier on the floor, table or other horizontal supporting surface.

It is another object of the present invention to provide a backpack-type child carrier having a substantially U-shaped supporting leg stand pivotally connected to the frame of the carrier, and wherein the leg stand has an enlarged ground-engaging or base portion so as to cooperate with the carrier to prevent accidental tipping of the carrier.

It is still another object of the present invention to provide a backpack-type child carrier having a novel and improved hinge mechanism for a leg stand which is adapted to be quickly and easily secured to the framework of existing child carriers and yet provide the positive connection between the leg stand and the child carrier necessary to stabilize the carrier on a supporting surface.

These and other objects of the present invention are attained with a new and improved leg stand assembly adapted to be hingedly connected to side frame members of the carrier and having an expanded or enlarged base portion which is bowed or angled rearwardly and laterally away from the side frame members.

More specifically, a U-shaped frame of the leg stand has side leg portions which are spaced substantially the same as the spacing between the side frame members of the carrier frame and which has a base portion flaring laterally away from the side leg members and also outwardly in a direction away from the frame of the carrier to optimize the stability of the carrier. The generally U-shaped leg stand is pivotally connected to the side frame members of the carrier frame by unique hinge mechanisms which include a sleeve member adapted to be selectively but positively positioned along the length of a side frame member by a wedge member inserted between the sleeve member and the side frame member and a socket member pivotally connected to the sleeve member and adapted to be fixidly received on an end of the leg stand to allow the leg stand to pivot relative to the frame of the carrier. It will be appreciated from the detailed description hereinafter that the hinge mechanisms allow only limited pivotal or swinging movement of the leg stand between contracted and extended positions.

Figure 2:
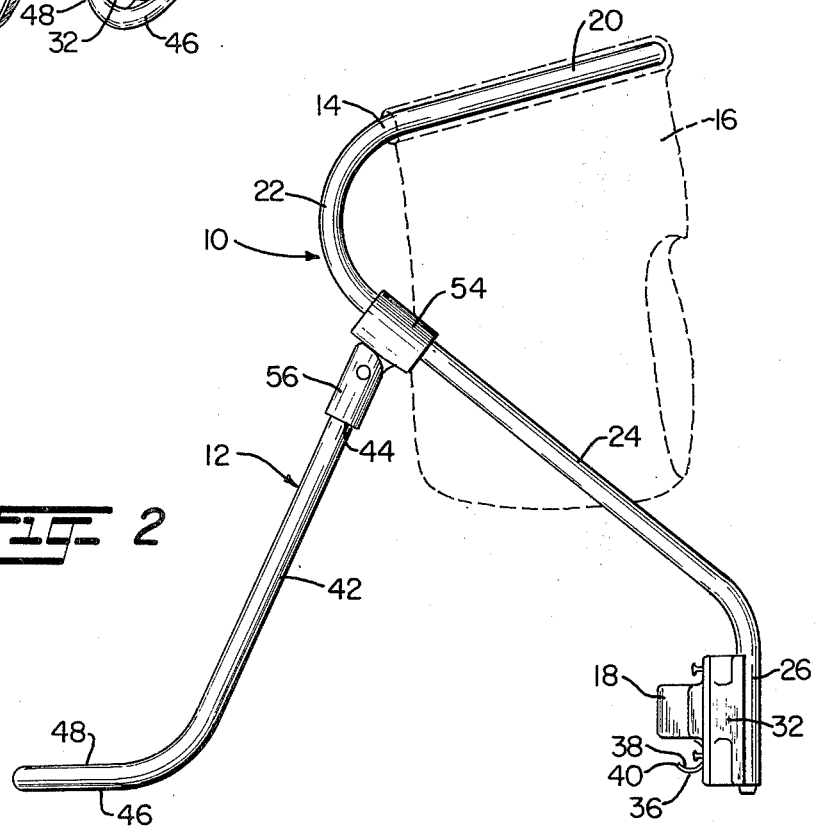
Figure 3:
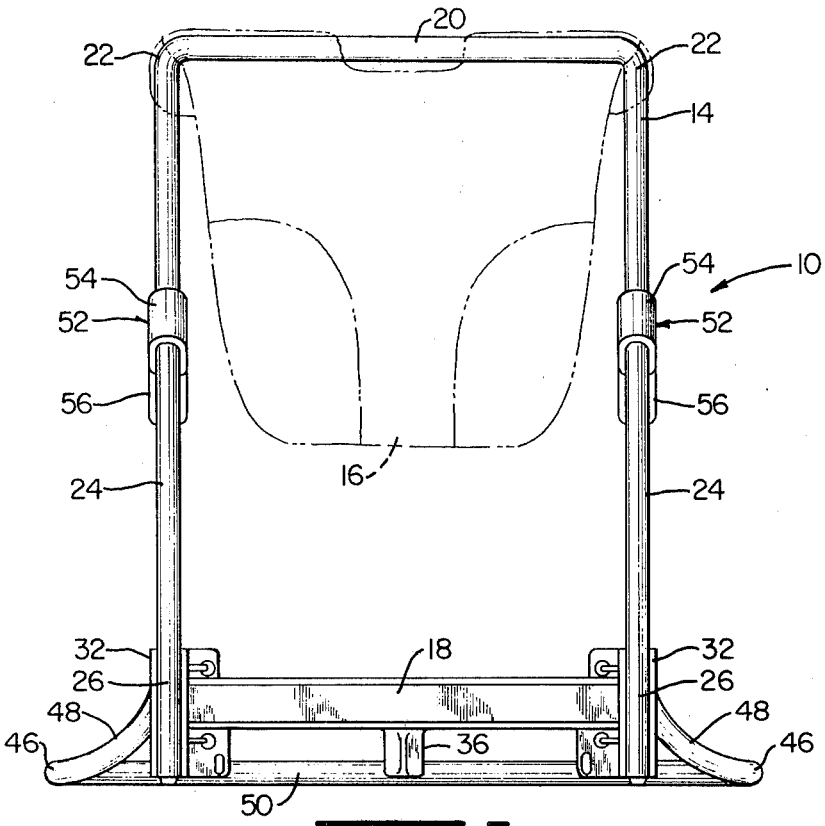
Figure 4:
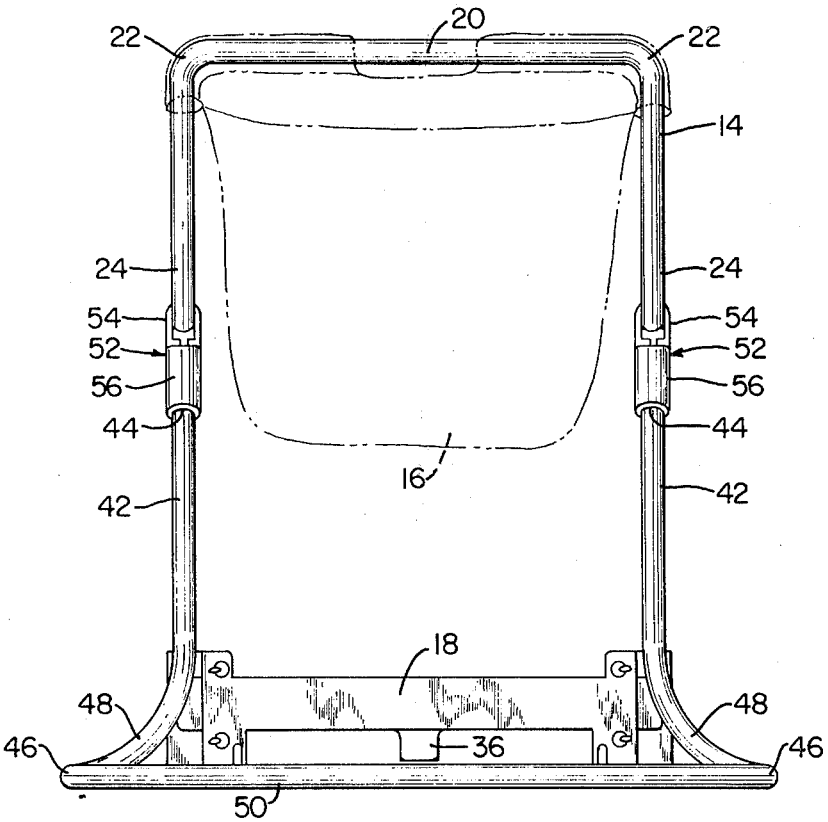
Figure 5:
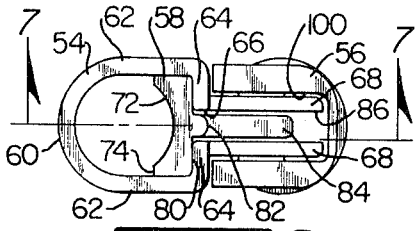
Figure 6:
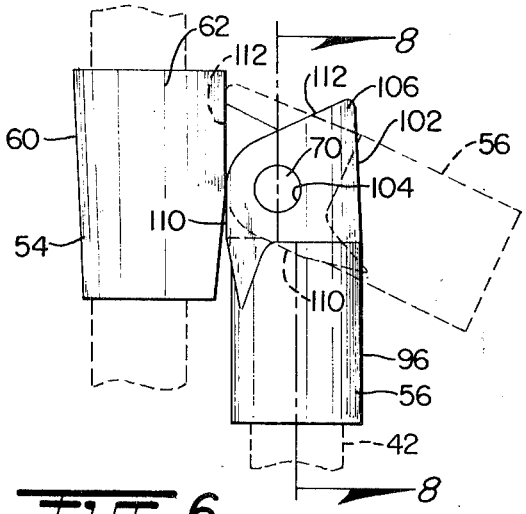
Figure 7:
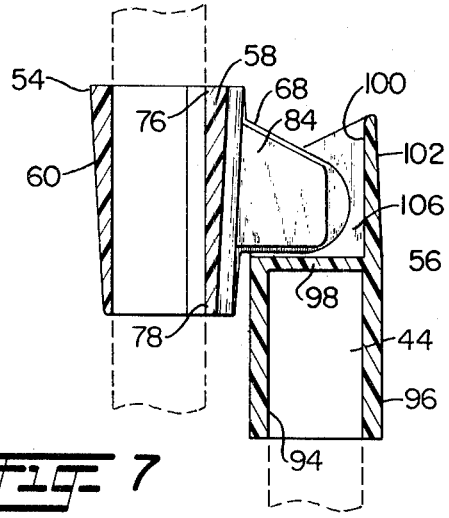
Figure 8:
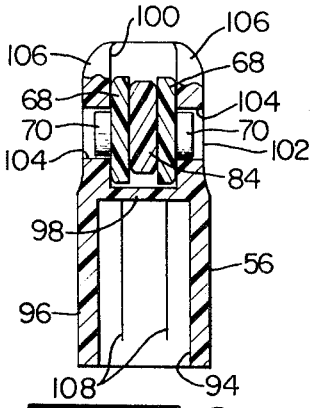
Figure 9:
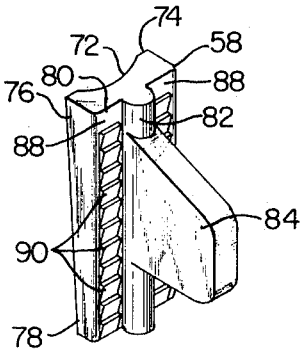
Figure 10:
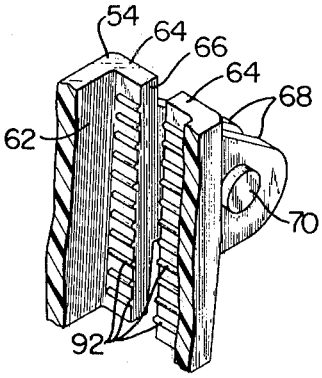

Other objects, advantages and capabilities of the present invention will become more apparent as the description proceeds taken in conjunction with the accompanying drawings, in which:

FIG. 1 is a perspective view of a child carrier having the leg stand of the present invention connected thereto, FIG. 2 is a side elevation of the child carrier of FIG. 1 with parts removed for clarity, FIG. 3 is a front elevation of the child carrier of FIG. 1 with parts removed for clarity, FIG. 4 is a rear elevation of the child carrier of FIG. 1 with parts removed for clarity, FIG. 5 is a top plan view of the hinge mechanism utilized to connect the leg stand to the framework of the child carrier of FIG. 1, FIG. 6 is a side elevation of the hinge mechanism shown in FIG. 5 and illustrating the two stabilizing positions taken by the hinge to retain the leg stand in the deired positions, FIG. 7 is a section taken along line 7—7 of FIG. 5, FIG. 8 is a section taken along line 8—8 of FIG. 6, FIG. 9 is a perspective view of the wedge element of the hinge shown in FIG. 5, and FIG. 10 is a fragmentary perspective view of the interior of the sleeve element of the hinge of FIG. 5.

Referring first to FIG. 1, a child carrier 10 of the general type disclosed in the aforementioned U.S. Pat. No. 3,421,670 is shown having the leg stand or support 12 of the present invention connected thereto. The carrier 10 includes a metal frame 14 of light-weight aluminum alloy or other suitable material and a pouch or seat 16 for a child constructed of light canvas or other suitable fabric and including a connecting bar 18 at the lower end of the frame 14 to rigidify the frame. The connecting bar 18 is substantially of the type disclosed in co-pending application Ser. No. 208,753 now U.S. Pat. No. 3,774,827 which is also of common ownership with the present application.

The frame 14 of the carrier 10 comprises a single length of tubing bent to provide a substantially horizontal generally rectangular loop 20 at the top connected by curved portions 22 to sloping side frame members 24 which extend forwardly and downwardly in parallel substantially vertical planes and terminate in straight slightly rearwardly and downwardly directed terminal end portions 26. The pouch 16 of the carrier is wrapped loosely about the rectangular loop portion 20 of the frame 14 and sewed to provide a tube or envelope in which the frame is loosely held. Conventional shoulder straps 28 are connected at an intermediate portion of the rectangular loop 20 and extend in spaced relation downwardly across the front of the carrier to attachment loops 30 secured to the frame at the lower ends of the sloping side frame members 24.

The connecting bar 18 has sockets 32 at opposite ends thereof which seat the lower terminal ends 26 of the frame 14 and biases the lower ends 26 in an outward lateral direction to rigidify the frame. The connecting bar is also used to anchor the ends of a cushioning strap 34 which extends laterally across the lower end of the frame so as to engage the user of the carrier in a lower back region and thereby transmit a portion of the load into the user's back. As best seen in FIGS. 1 and 2, the connecting bar 18 has a centrally located downwardly and rearwardly projecting catch 36 which has an upwardly opening transversely extending groove defining an upturned lip 40. The catch 36 which preferably is made of a semi-rigid material is provided to secure the leg stand 12 in a contracted non-supporting position as will be explained more fully hereinafter.

The leg stand 12 can be seen in FIGS. 1 through 4 to comprise a fixed length of light-weight tubing, such as an aluminum alloy or other such material, which is bent to assume a substantially U-shaped configuration. The stand includes a pair of straight parallel side leg members 42 terminating in upper free ends 44 and a base or lower closed end 46 which is continuous with the lower ends of the side leg members. The base is defined by a pair of curved extension portions 48 which diverge laterally outwardly and away from one another and also curve rearwardly from the lower ends of the side leg members then reverse in a smooth curve to extend in a laterally inwardly direction toward one another to form a bottom, transverse ground-engaging member 50. The base 46 thereby forms an obtuse angle with the plane of the side leg members 42 and accordingly extends rearwardly as well as laterally outwardly from the side leg members to establish a broad based, stabilizing leg for the carrier as will be pointed out more clearly later.

The leg stand is pivotally connected to the sloping side frame members 24 of the carrier frame 14 by hinge members 52 so that the side leg members 42 of the stand extend in substantially parallel spaced relation to the sloping side frame members 24 of the carrier frame when the stand is in its contracted non-supporting position adjacent the frame of the carrier. In the contracted position, the base 46 of the stand, which flares rearwardly from the side leg members, can be seen, FIG. 1, to extend in a plane substantially parallel to a plane defined by the terminal ends 26 of the side frame members so that the stand substantially conforms to the configuration of the side frame members 24.

When the leg stand 12 is folded into its contracted position closely adjacent to the side frame members 24, the transverse leg member 50 of the stand 12 can be snapped into the catch 36 on the cross bar 18 and thereby positively held in compact relation with the frame of the carrier. The stand is pivotally connected to the sloping side frame members 24 of the frame 14 at a location such that the upturned lip 40 on the catch 36 is slightly higher than the lower extent of the transverse frame member 50 so that the transverse leg member must be forced over the lip and thereby will remain snapped in place within the upwardly opening groove 38 in the catch. Alternately, when it is desired to swing the leg stand into an extended supporting position, FIGS. 2 through 4, the transverse leg 50 can be forced over the lip 40 of the catch and thereby released in a quick and easy manner.

The configuration of the base portion 46 of the stand 12 relative to the side leg members 24 is important in establishing a stable and broad supporting assembly to brace and otherwise support the carrier in an upright or vertically oriented position as shown in FIGS. 2 through 4. It can be appreciated in these Figures that the base portion 46 of the stand and the terminal ends 26 of the frame 14 of the carrier establish ground-engaging legs of a supporting assemblage which is designed to positively stabilize the carrier against downward, for and aft, and lateral forces which might otherwise upset the carrier. As best seen in FIG. 2, the rearward flare of the base portion 46 relative to the side legs 42 allows the transverse leg 50 of the stand to be optimally spaced from the terminal ends 26 of the carrier frame without creating a large angular relationship between the side frame members 24 and the side legs 42. As best seen in FIGS. 3 and 4, the lateral outward flare of the base portion 46 relative to the legs 42 establishes a relatively broad base for the assembly so as to optimize lateral support and prevent the carrier from tipping sideways or in a lateral direction. As can be appreciated, this broad support for the carrier which is provided by the leg stand 12 is attained even though when the leg stand is positioned in its contracted non-supporting position, it does not extend beyond the lower extent of the carrier frame 14 and is conveniently positioned adjacent the frame so as not to be a nuisance or encumbrance to the user of the carrier when it is carried on the user's back.

The hinge member 52 utilized to connect each leg member 42 of the stand 12 to the frame 14 of the child carrier is best seen in FIGS. 5 through 10 to include a sleeve portion 54, a socket portion 56, and a wedge portion 58. The sleeve portion 52 is loosely received on an associated frame member 24 of the carrier frame and fixidly positioned along the length of the side member by the wedge portion 58 which is forced between the side frame member 24 and the sleeve 54 to pinch the side frame member within the sleeve. The socket portion 56 of the hinge 52 is pivotally connected to the sleeve 54 and adapted to tightly receive the upper terminal end 44 of an associated side leg 42 of the stand 12 so that the stand is positively but pivotally connected to the frame of the carrier in a stable and reliable manner.

The sleeve member 54 includes a generally tubular body having a semi-cylindrical front wall 60, rearwardly extending and parallel flat side walls 62 and a pair of inwardly directed rear flanges 64 defining an elongated slot 66 therebetween. Generally oval-shaped ears 68 extend rearwardly from the inner edges of the rear flanges 64 in parallel spaced relation and have oppositely directed cylindrical pivot pins 70 extending outwardly therefrom. The radius of curvature of the inner surface of the semi-cylindrical front wall 60 of the sleeve is preferrably the same as the outside radius of curvature of the side frame members 24 of the carrier so that the sleeve can be slid onto one of the side frame members and the side frame will conform with the inner curvature of the semi-cylindrical front wall. It can be seen that the axial passage through the sleeve is larger than the outer diameter of the side frame members 24 so that the wedge member 58 can be forced into the passage between the side frame member and the rear flanges 64 of the sleeve to wedge and thereby secure the side frame member in the sleeve at a selected fixed location along the length of the side frame member.

The wedge member 58, which is best seen in FIG. 9, is seen to comprise an elongated bar of generally rectangular configuration which has a forwardly opening longitudinally extending groove 72 in its front surface 74 which has a radius of curvature conforming with the outer surface of the side frame members 24. The upper end 76 of the bar is seen to be slightly thicker then the lower end 78 so that the wedge member can be driven downwardly into the space between the side frame member 24 and the rear flanges 64 of the sleeve 54 in tightening the sleeve onto the side frame member. The rear 80 of the bar has a centrally located longitudinally extending rib 82 with a generally oval-shaped protrusion 84 extending in a normal direction away from the rear surface 80 of the bar. The rearward protrusion 84 can be seen to conform in configuration with the ears 68 on the sleeve and is of a thickness adapted to fit into the space 86 between the ears when the wedge member is inserted into the sleeve between the side frame member and the rear flanges 64. It can be seen that the longitudinally extending rib 82 separates longitudinally extending faces 88 on the rear surface 80 of the bar each of which has a plurality of aligned wedge-shaped teeth 90 adapted to cooperate with a plurality of horizontal transversely extending ribs 92 on the inner or forward faces of the flanges 64 to lock the wedge member 58 in the sleeve 54 between the side frame member 24 and the flanges 64. It can, therefore, be appreciated that the sleeve member of the hinge can be positively positioned along the length of an associated side frame member so as to anchor the hinge to the side frame member in a positive manner.

The socket portion 56 of the hinge is generally cylindrical in configuration and as best seen in FIG. 7, has a downwardly opening cylindrical socket 94 in a lower portion 96 thereof separated by a partition 98 from an upwardly and forwardly opening recess 100 in an upper portion 102. The upper portion 102 of the socket member has a pair of circular apertures 104 through the side walls 106 of the recess 100 which have a diameter substantially the same as the outwardly directed cylindrical pivot pins 70 on the ears 68 of the sleeve 54. The width of the recess 100 in the upper portion of the socket member is substantially the same as the distance between the outer faces of the ears 68 on the sleeve member so that the ears on the sleeve member can be slid into the recess 100. Inasmuch as the pivot pins 70 protrude outwardly from the outer faces of the ears 68, it is necessary to flexibly press the ears together and then slide them into the recess 100 until the cylindrical pivot pins snap outwardly into the cylindrical apertures 104 in the sides 106 of the recess thereby pivotally retaining the socket member on the sleeve member. The cylindrical socket 94 in the lower portion 96 of the socket member 56 has an internal diameter slightly less than the outer diameter of the side leg members 42 of the leg stand 12 so that the upper terminal end 44 of a leg member can be forced into the socket 94 establishing a tight press fit between the socket member 56 and the associated leg member 42 to positively retain the socket member on the upper end of the leg member. As shown in FIG. 8 a plurality of circumferentially spaced longitudinally extending inwardly directed ribs 108 are provided on the inner surface of the socket 94 so as to assist in preventing relative rotation between the two members.

The front surfaces 110 of the sides 106 of the upper portion 102 of the socket member 56 are flattened and form an obtuse angle with the flattened top surfaces 112 of the sides 106 establishing two pair of abutment surfaces which limit the pivotal movement of the socket member 56 relative to the sleeve member 54. As is best illustrated in FIG. 6, the front flat surfaces 110 of the sides 106 abut the rear flanges 64 of the sleeve 54 when the longitudinal axes of the sleeve member and the socket member are substantially parallel, such as when the leg stand is in its contracted non-supporting solid line position of FIG. 6. Pivotal movement of the socket member to the dotted line position of FIG. 6, however, moves the flat upper surfaces 112 of the sides 106 into abutment with the rear flanges 64 of the sleeve so that the longitudinal axes of the sleeve and socket members form an acute angle with each other, as illustrated in FIG. 6, allowing the leg stand 12 to extend rearwardly away from the side frame members 24 as when it is in the extended supporting position shown in FIG. 2. Accordingly, the leg stand 12 is free to swing between the contracted position of FIG. 1 and the extended position of FIG. 2 but is not allowed to pivot beyond these two positions due to the engagement of the abutment surfaces 110 and 112 with the sleeve member. It can, therefore, be appreciated that when the leg stand 12 is in the extended supporting position of FIG. 2, it is not permitted to pivot beyond that position and thereby establishes a rigid supporting leg for the carrier to retain the pouch for the child in an upright orientation. It should also be noted that the leg portions 42 of the leg stand make an acute angle with vertical when in the extended position so that the weight of the child positively maintains the stand in its extended position.

Accordingly, it can be seen that the leg stand 12 provides a sturdy stabilizing leg for the carrier 10 when in its extended position and due to the angular relationship of the base portion 46 of the stand to the side legs 24 and the curved lateral extensions 48 of the base portion beyond the side legs, an optimal broad stance is established to resist downward, fore and aft, and lateral forces which could otherwise upset the carrier. Also of importance is the fact that even though the leg stand gives you a broad stance to the carrier, it can be folded into compact relationship with the carrier frame when not used to brace the carrier without discomforting the person supporting the carrier on his back or otherwise encumbering the carrier.

Although the present invention has been described with a certain degree of particularity, it is understood that the present disclosure has been made by way of example and that changes in details of structure may be made without departing from the spirit thereof.

What is claimed is:

1. In a carrier for supporting a load on a person's back having a frame with means for suspending the load from the frame and a support stand for stabilizing the carrier in an upright orientation on a supporting surface, the improvement comprising:

hinge means interconnecting said frame and said support stand, said hinge means including a sleeve member having a portion of said frame passing therethrough, a socket member anchored to said support stand and pivotally connected to the sleeve member, and wedging means inserted between said sleeve member and the frame to wedge said sleeve member relative to the frame and thereby prevent relative movement therebetween whereby said leg stand is pivotal relative to said frame between extended and contracted positions, said sleeve member including means pivotally connecting said socket member to said sleeve member, wherein said wedging means cooperates with said sleeve member to prevent disengagement of the socket member and sleeve member at the pivotal connection.

2. In the carrier of claim 1 wherein said sleeve member comprises an elongated generally tubular body having a longitudinally extending slot in a rear portion thereof, a pair of extensions from said body protruding rearwardly on opposite sides of said slot, each of said extensions having pivot pins on which said socket members are mounted, and wherein said wedging means has a rearwardly extending protrusion passing through said slot and received between said extensions on the sleeve member.

3. In the carrier of claim 2, further including cooperating lock means on said sleeve member and on said wedging means to positively retain said wedging means in position between said frame and the sleeve member.

4. In the carrier of claim 3, wherein said lock means comprise a plurality of wedge-shaped teeth on one of said sleeve and wedging means and a plurality of cooperating ribs on the other of said sleeve and wedging means with the teeth adapted to slide over the ribs as said wedging means is inserted into the sleeve in one direction and be locked on the ribs to prevent said wedging means from being moved in an opposite direction.

5. In the carrier of claim 2, wherein said socket members have a socket in one end thereof and wherein said support stand has a pair of leg portions adapted to be securely received in the socket of one of said socket members.

6. In the carrier of claim 5, wherein each socket member has a pair of side walls at the end opposite from said socket and wherein said side walls each have an aperture therein pivotally receiving one of said pivot pins on the rearward extensions of the sleeve member.

7. In the carrier of claim 6, wherein said side walls each have a front and top surface disposed for alternate abutting engagement with the sleeve member when the stand is in one of said extended and contracted positions to limit pivotal movement of the stand relative to the frame.

8. In the carrier of claim 7, wherein said front surface of each side wall abuts the sleeve member when the leg portions of the stand and the frame are substantially parallel.

9. In the carrier of claim 8, wherein said leg portions of the stand and the frame form an acute angle when said top surface of each side wall abuts the sleeve member.

10. In a carrier for supporting a load on a person's back having a frame which includes parallel side frame members adapted to pass along opposite sides of the person's back, the improvement comprising:

a pair of hinges connected to said side frame members, each hinge including a sleeve member having a side frame member passing therethrough, a socket member, and a wedge member, said sleeve member comprising an elongated tubular body having a semi-cylindrical front wall, a longitudinally extending slot in a rear portion thereof, and a pair of ears extending rearwardly from said body on opposite sides of said slot, each of said ears having a pivot pin extending laterally outwardly therefrom, said wedge member being inserted into said sleeve between the associated side frame member and the rear portion of the sleeve and having an elongated body with a groove in a front face thereof adapted to mate with a side frame member and a rearwardly directed protrusion extending through said slot in the sleeve member into a position between said ears of the sleeve member, and cooperating lock means on said wedge member and sleeve member to prevent movement therebetween, said socket member comprising an elongated body with a socket in one end thereof, a pair of spaced parallel side walls at the other end thereof, each side wall having an aperture therein pivotally receiving one of said pivot pins on the ears of the sleeve member and a front and top abutment surface disposed for selective abutment with the sleeve member to limit pivotal movement of the socket member relative to the sleeve member, and a support stand, said support stand having a generally U-shaped configuration with a pair of spaced parallel leg portions and a base portion, one end of said leg portions being securely received in the socket of an associated socket member, the opposite end of each leg portion being continuous with the base portion, the base portion having a pair of curved sides which curve laterally outwardly away from the associated leg portion as well as away from a plane defined by the leg portions and then pass through a reverse curve to be directed laterally inwardly, and a transverse member interconnecting the inwardly directed portions of the curved sides, said support stand being pivotally movable between a contracted position with the leg portions extending substantially parallel to the side frame members and an extended position with the leg portions forming an acute angle with the side frame members when the front and top abutment surfaces of the side walls on the socket member are alternately engaged with the sleeve member.

11. In a carrier for supporting a load on a person's back having a frame with spaced side frame members and terminating in a rearwardly inclined lower terminal end portion and means for suspending the load from the frame, the improvement comprising:

a support stand of generally U-shaped configuration adapted to support said carrier in an upright disposition on a supporting surface, said support stand having spaced leg portions corresponding to the spacing between said side frame members and a base portion, said base portion defined by a generally looped member having extension portions curving rearwardly and diverging laterally away from the lower end of each leg portion into a substantially horizontally extending base portion, the width of said base portion being greater than the spacing between the lower ends of said leg portion, and hinge means attaching the upper end of said leg portions to said side frame members whereby said support stand is foldable into a contracted position extending along and conforming to the configuration of said side frame members and lower terminal end portions and an extended position in which said base portion extends substantially horizontally so as to rest upon a supporting surface when said lower terminal end portion is in a substantially vertical dispostion in resting upon the supporting surface so as to support the carrier in an upright disposition said hinge means including a sleeve member having a portion of said frame passing therethrough, a socket member anchored to said support stand and pivotally connected to the sleeve member, and wedging means inserted between said sleeve member and the frame to wedge said sleeve member relative to the frame and thereby prevent relative movement therebetween whereby said leg stand is pivotal relative to said frame between extended and contracted positions, said sleeve member including means pivotally connecting said socket member to said sleeve member, wherein said wedging means cooperates with said sleeve members to prevent disengagement of the socket member and sleeve member at the pivotal connection.

12. In the carrier of claim 11, wherein said leg portions of the support stand are parallel substantially straight elongated members.

13. In the carrier of claim 12, wherein each of said extension portions comprise a curved member which diverges laterally from the lower end of the associated leg portion then undergoes a reverse curve to be directed laterally inwardly and define a bottom surface for said leg stand.

* * * * *